US011069283B2

(12) United States Patent
Cauwood et al.

(10) Patent No.: US 11,069,283 B2
(45) Date of Patent: Jul. 20, 2021

(54) MESSAGING APPARATUS FOR WEARABLE ITEMS

(71) Applicant: adidas AG, Herzogenaurach (DE)

(72) Inventors: Peter David Cauwood, Cambridgeshire (GB); Keir Samuel Jackson, Cumbria (GB); Keith Paul Thompson, Cambridgeshire (GB); Constantin Zwick, Nuremberg (DE); Tomek Kamil Cegielny, Nuremberg (DE); Scott James Grubb, Cambridge (GB); Peter Georg Laitenberger, Cambridge (GB)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 16/690,863

(22) Filed: Nov. 21, 2019

(65) Prior Publication Data

US 2020/0090581 A1 Mar. 19, 2020

Related U.S. Application Data

(63) Continuation of application No. 15/834,796, filed on Dec. 7, 2017, now Pat. No. 10,522,071.

(30) Foreign Application Priority Data

Dec. 9, 2016 (DE) ..... 102016224587.2

(51) Int. Cl.
*G09G 3/32* (2016.01)
*A43B 3/00* (2006.01)
(Continued)

(52) U.S. Cl.
CPC ..... *G09G 3/32* (2013.01); *A41D 1/002* (2013.01); *A43B 3/001* (2013.01); *A43B 3/0005* (2013.01);
(Continued)

(58) Field of Classification Search
CPC ..... G09G 3/003; G09G 3/005; G09G 3/004; A43B 3/001
See application file for complete search history.

(56) References Cited

U.S. PATENT DOCUMENTS 5,457,900 A 10/1995 Roy
5,748,157 A 5/1998 Eason
(Continued)

FOREIGN PATENT DOCUMENTS

CN 1324476 11/2001
CN 102369046 3/2012
(Continued)

OTHER PUBLICATIONS

"Visual Poi V3—New Divide, Pyroterra Lighttoys", available at https://www.youtube.com/watch?v=LGy0neDXxAE, Nov. 9, 2014, 2 pages.
(Continued)

*Primary Examiner* — Kevin M Nguyen
(74) *Attorney, Agent, or Firm* — Kilpatrick Townsend & Stockton LLP

(57) ABSTRACT

A messaging apparatus for wearable items. The messaging apparatus may comprise a light source, at least one sensor to detect an event, and a controller to control the flashing of the light source in response to the detection of the event. The controlling of the flashing of the light source may generate at least one visible element that is visible to a viewer. Further, the light source may not be adapted in the form of the at least one visible element, but rather, the controlled flashing of the light source may be in the form of the at least one visible element.

20 Claims, 4 Drawing Sheets

(51) Int. Cl.

| | |
|---|---|
| ***A41D 1/00*** | (2018.01) |
| ***A43B 5/06*** | (2006.01) |
| ***A43B 5/02*** | (2006.01) |
| ***G09G 3/00*** | (2006.01) |
| ***G09F 9/33*** | (2006.01) |
| ***G09F 19/12*** | (2006.01) |
| ***G09F 21/02*** | (2006.01) |
| ***G09F 27/00*** | (2006.01) |
| ***G09F 23/00*** | (2006.01) |
| ***G09G 5/40*** | (2006.01) |

(52) U.S. Cl.

CPC ..... *A43B 3/0078* (2013.01); *A43B 5/02* (2013.01); *A43B 5/06* (2013.01); *G09F 9/33* (2013.01); *G09F 19/12* (2013.01); *G09F 21/02* (2013.01); *G09F 23/0066* (2013.01); *G09F 27/005* (2013.01); *G09G 3/005* (2013.01); *G09G 5/40* (2013.01); *G09F 21/023* (2020.05); *G09G 2320/0626* (2013.01); *G09G 2330/02* (2013.01); *G09G 2354/00* (2013.01); *G09G 2370/06* (2013.01); *G09G 2370/16* (2013.01)

(56) References Cited

U.S. PATENT DOCUMENTS

| | | | | |
|---|---|---|---|---|
| 5,813,148 | A * | 9/1998 | Guerra | A43B 1/0036 36/137 |
| 5,926,090 | A * | 7/1999 | Taylor | G08B 21/023 340/539.32 |
| 6,265,984 | B1 | 7/2001 | Molinaroli | |
| 7,428,471 | B2 | 9/2008 | Darley et al. | |
| 7,494,237 | B1 | 2/2009 | Cheung | |
| 8,474,146 | B2 | 7/2013 | Hartford et al. | |
| 8,516,724 | B2 | 8/2013 | Diepenbrock et al. | |
| 8,650,764 | B2 | 2/2014 | Hartford et al. | |
| 8,769,836 | B2 | 7/2014 | Donovan et al. | |
| 8,982,150 | B2 | 3/2015 | Odland et al. | |
| 9,078,488 | B1 | 7/2015 | Meir et al. | |
| 9,216,552 | B2 | 12/2015 | Diepenbrock et al. | |
| 9,226,542 | B2 | 1/2016 | Hartford et al. | |
| 9,301,573 | B2 | 4/2016 | Jasmine | |
| 2003/0231513 | A1 | 12/2003 | Wei | |
| 2008/0019119 | A1 | 1/2008 | Marston | |
| 2010/0184563 | A1 | 7/2010 | Molyneux et al. | |
| 2012/0251079 | A1 | 10/2012 | Meschter et al. | |
| 2013/0106603 | A1 | 5/2013 | Weast et al. | |
| 2013/0298039 | A1* | 11/2013 | Mestre | H04M 1/22 715/753 |
| 2014/0268839 | A1 | 9/2014 | Timmerberg | |
| 2015/0029005 | A1 | 1/2015 | Kim | |
| 2016/0057803 | A1* | 2/2016 | Kim | H04W 52/0209 370/329 |
| 2016/0089816 | A1 | 3/2016 | Diepenbrock et al. | |
| 2016/0301581 | A1* | 10/2016 | Carter | H04W 4/029 |
| 2016/0338441 | A1 | 11/2016 | London | |
| 2016/0374171 | A1* | 12/2016 | Wilken | G05B 15/02 |

FOREIGN PATENT DOCUMENTS

| | | |
|---|---|---|
| JP | 2012510873 | 5/2012 |
| WO | 0017843 | 3/2000 |
| WO | 2010065836 | 6/2010 |
| WO | 2016040965 | 3/2016 |

OTHER PUBLICATIONS

U.S. Appl. No. 15/834,796 , "Corrected Notice of Allowability", dated Nov. 20, 2019, 2 pages.

U.S. Appl. No. 15/834,796 , "Non-Final Office Action", dated Apr. 19, 2019, 15 pages.

U.S. Appl. No. 15/834,796 , "Notice of Allowance", dated Aug. 13, 2019, 7 pages.

Chicoine, "Monkey Light Pro Animations", available at https://www.youtube.com/watch?v=XDdygLS8qjw, Youtube Video, May 31, 2013, 3 pages.

Chinese Application No. 201711308254.X, Office Action dated Mar. 20, 2019, 15 pages (English translation provided).

Chinese Patent Application No. 201711308254.X, Office Action dated Oct. 18, 2019, 15 pages (English machine translation provided).

German Patent Application No. 102016224587.2, Office Action dated Jul. 6, 2017, 5 pages (English summary provided in IDS Transmittal filed Dec. 7, 2017).

European Patent Application No. 17205866.1, Extended European Search Report dated Apr. 23, 2018, 9 pages.

Japanese Application No. 2017-235768, Office Action dated Apr. 2, 2019, 9 pages (English translation provided).

Vimeo, "Portable USB Fan with LED Messag", Vimeo video, available at https://vimeo.com/71311095, 2013, 2 pages.

German Patent Application No. 102016224587.2, Office Action, dated Nov. 5, 2020, 12 pages (English machine translation provided).

European Patent Application No. 17205866.1, Office Action, dated Mar. 23, 2020, 7 pages.

* cited by examiner

MESSAGING APPARATUS FOR WEARABLE ITEMS

CROSS REFERENCE TO RELATED APPLICATION

This is a continuation of U.S. patent application Ser. No. 15/834,796 entitled "Messaging Apparatus for Wearable Items", filed Dec. 7, 2017 (Allowed), which is related to and claims priority benefits from German Patent Application No. 102016224587.2 entitled "Messaging Unit for Pieces of Apparel and Sports Equipment", filed Dec. 9, 2016, the contents of which are incorporated herein by reference.

FIELD OF THE INVENTION

The present invention generally relates to a messaging apparatus for wearable items (e.g., apparel, wearable accessories, and the wlike). More particularly, the present invention relates to a messaging apparatus embedded in a wearable item, which includes at least one visible element (e.g., a letter, number, graphical symbol, or design element) that flashes in response to an event.

BACKGROUND

In recent years, a number of rotatable devices have been marketed, such as a fan or a bicycle wheel, which include flashing light emitting diodes (LEDs) to display a text message. These devices use the principle of "persistence of vision". Persistence of vision (POV) refers to the phenomenon of the human vision in which an afterimage exists for a brief time (of the order of 10 ms to 40 ms). A POV display exploits this phenomenon by spinning a one-dimensional row of LEDs along a circular path at a sufficiently high frequency and controlling the flashing of the LEDs, so that a two-dimensional image is visible.

Wearable items, such as apparel and sports equipment, usually provide certain functionality to the user. For example, shoes, in particular sport shoes, generally provide friction between the foot and the ground, promote or facilitate certain aspects of the sport, and also protect the foot. Existing solutions provide shoes, apparel or garments with lights or image displaying devices to change the outer appearance or the shoe or enhance visibility of the shoe. Such devices or lights can display various graphical elements, for example, the logo of the manufacturer of the garment or of a certain sports team. Often provision of such displays affect or interfere with the primary functionality of the equipment or shoe.

Various light arrangements or image displaying devices for shoes are known. For example, U.S. Publication No. 2015/0029005A1 (entitled "Remotely Activated Illuminated Shoe") discloses a show for which the illumination is controlled by a hand-held activation device, such as a keychain or smartphone, whereby a portion of the shoe is illuminated in a variety of burst modes.

Other examples are described in U.S. Pat. No. 8,474,146 B2, U.S. Pat. No. 8,769,836 B2, U.S. Pat. No. 9,226,542 B2 and U.S. Pat. No. 8,650,764 B2, which generally disclose articles of footwear with a color change portion capable of changing colors in response to a performance parameter, such as the distance travelled by the user.

U.S. Pat. No. 8,982,150 B2 describes a system for advertising on footwear by displaying promotional content on an electronic display of the footwear. The promotional content may be displayed in a manner that occupies 25% to 100% of the outer surface of the footwear. Additionally, the content can be displayed according to a plurality of conditions, including time of day, rate of motion of the footwear and environmental lighting condition around the footwear.

An article of footwear including an upper incorporating a knitted component having color-shifting properties is provided in U.S. Pat. No. 9,078,488 B1. Color-shift properties are generated by one or more lenticular knit structures disposed across the upper of the article of footwear. The one or more lenticular knit structures generate a visual effect that changes the color of the article of footwear depending on the viewing angle.

U.S. Publication No. 2014/0268839A1 discloses an illumination device for apparel or other worn garments by a rider of a motorcycle or scooter for enhancing the recognition of the motorcycle's presence by proximate vehicles. The illumination device changes the illumination of the apparel or garment in response to changes in other light sources or the proximity of a vehicle.

U.S. Pat. No. 8,516,724 B2; U.S. Pat. No. 9,216,552 B2; and U.S. Publication No. 2016/0089816A1 generally disclose devices for displaying an image on apparel, for example, a shoe, which uses raised and recessed portions in a display layer to vary light transmission and generate the image.

Other solutions include U.S. Pat. No. 9,301,573 B2, which discloses a detachable electronic display that can be used to display of images, animations or videos on footwear on footwear; and WO 2016/040965A1, which describes light emitting diodes (LED) lights embedded in the sole of footwear. The LED lights are adapted, such that the intensity and color can be changed by the user with a standard short-range wireless interconnection, such as Bluetooth technology.

However, a common disadvantage of the above-described existing solutions is that they either provide one or more static images, are not suitable to provide information to a spectator as they are typically too small or are quite voluminous (e.g., making them heavy), and thus, may reduce the performance of the wearer or the functionality of the equipment. Using existing solutions, it is therefore currently impossible to have, for example, a shoe of a professional soccer player presenting information or a design element in response to a measurement or an event in such a way that they can be visibly recognized by spectators in a stadium or in front of a TV without impairing performance.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Certain embodiments of the present invention enhance the process of presenting visual elements (e.g., text, numbers, symbols, designs, and so on) using light sources. Embodiments of the present invention provide a messaging apparatus that can be embedded in wearable items (e.g., apparel, sports equipment, wearable accessories). For example, the messaging apparatus can include a light source, a sensor, and a controller. The controller can control the flashing of the light source based on an event detected by the sensor. As a benefit, the controlled flashing of the light source may generate or form a visible element, such as a message. Further, the light source is not in the shape of the visible element, as in certain existing solutions described in the Background section above, but rather, the movement of the messaging apparatus embedded in the wearable item, along with the controlled flashing of the light source, forms the visible element.

As only a non-limiting example and for the purpose of illustration, the messaging apparatus may be embedded near the heel portion of a soccer shoe. A soccer player may wear the soccer shoe embedded with the messaging apparatus during a soccer game. The sensor in the messaging apparatus may detect that an action by the soccer player wearing the shoe. For example, the sensor may detect that the soccer player kicked a ball and scored a goal. In response to the detected event, the controller can control the flashing of the light source within the shoe (as part of the messaging apparatus) to present the current score of the game or the speed of the soccer ball when kicked. A "persistence of vision" effect can be achieved through the combination of controlling the flashing of the light source and the movement of the soccer shoe (e.g., the soccer player running), so that together, the "persistence of vision" effect results in a message being displayed to the fans in the stadium after the soccer player scores the goal. For example, fans can view a message displayed at the soccer player's shoe as a result of the combination of the controlled flashing of the light source and the movement of the soccer player's shoe.

According to certain embodiments of the present disclosure, a messaging apparatus may be provided. The messaging apparatus may comprise a light source, at least one sensor to detect an event, and a controller. The light source may be adapted to perform a flash operation. The controller may be adapted to control the flash operation of the light source in response to the detection of the event. The controlled flash operation of the light source may form at least one visible element that is visible to a viewer. The light source may not be adapted in the shape of the at least one visible element. For example, the light source may be a plurality of light emitting diodes (LEDs) that form the visible element using the "persistence of vision" effect.

In some embodiments, the light source may have a length in one dimension in the range of approximately 1 cm to 5 cm.

The controller may be further adapted to initiate control of the flash operation of the light source when a threshold velocity condition is satisfied.

The controller may be further adapted to initiate control of the flash operation of the light source when a threshold acceleration condition is satisfied.

For example, the threshold acceleration condition may correspond to a threshold value is in a range between 1 g to 5 g.

In some embodiments, the at least one sensor may be further adapted to determine a direction of a motion of the messaging apparatus.

The controller may be further adapted to initiate control of the flash operation if the determined direction of the motion corresponds to one or more predetermined directions. For example, the one or more predetermined directions may correspond to a wearer of the messaging apparatus kicking a ball. As another example, the one or more predetermined directions may correspond to a jump motion of a wearer of the messaging apparatus.

In some embodiments, the controller may be further adapted to control a frequency of the flash operation. The frequency may be based on an acceleration value of a determined direction of a motion of the messaging apparatus.

In some embodiments, the messaging apparatus may further include a programmable device. The programmable device may be adapted to execute code associated with the at least one visible element. In some embodiments, the messaging apparatus may further include an interface for externally programming the at least one visible element.

The light source may include a plurality of light sources. The controller may be further adapted to initiate control of the flashing operation of the plurality of light sources depending on receiving an additional external signal.

The controller may be further adapted to track a running distance or a speed of a wearer. The running distance or the speed may be tracked using the at least one sensor.

The at least one sensor may comprise at least one from the following group of devices: motion sensing devices, accelerometers, gyroscopes, magnetometer, inertial measurement units, proximity sensing devices, contact switches, proximity sensors, orientation sensing devices, and inclination sensors.

The messaging apparatus may be embedded within a wearable item worn by a wearer. In some embodiments, the wearable item may be a shoe, a garment, or a wearable accessory. For example, when the wearable item is a shoe, the light source may be arranged on a lateral side of the shoe. As another example, when the wearable item is a shoe, the light source may be arranged in a heel portion of the shoe.

BRIEF DESCRIPTION OF THE DRAWINGS

In the following detailed description, embodiments of the invention are described referring to the following figures.

BRIEF DESCRIPTION

Figure 1A:
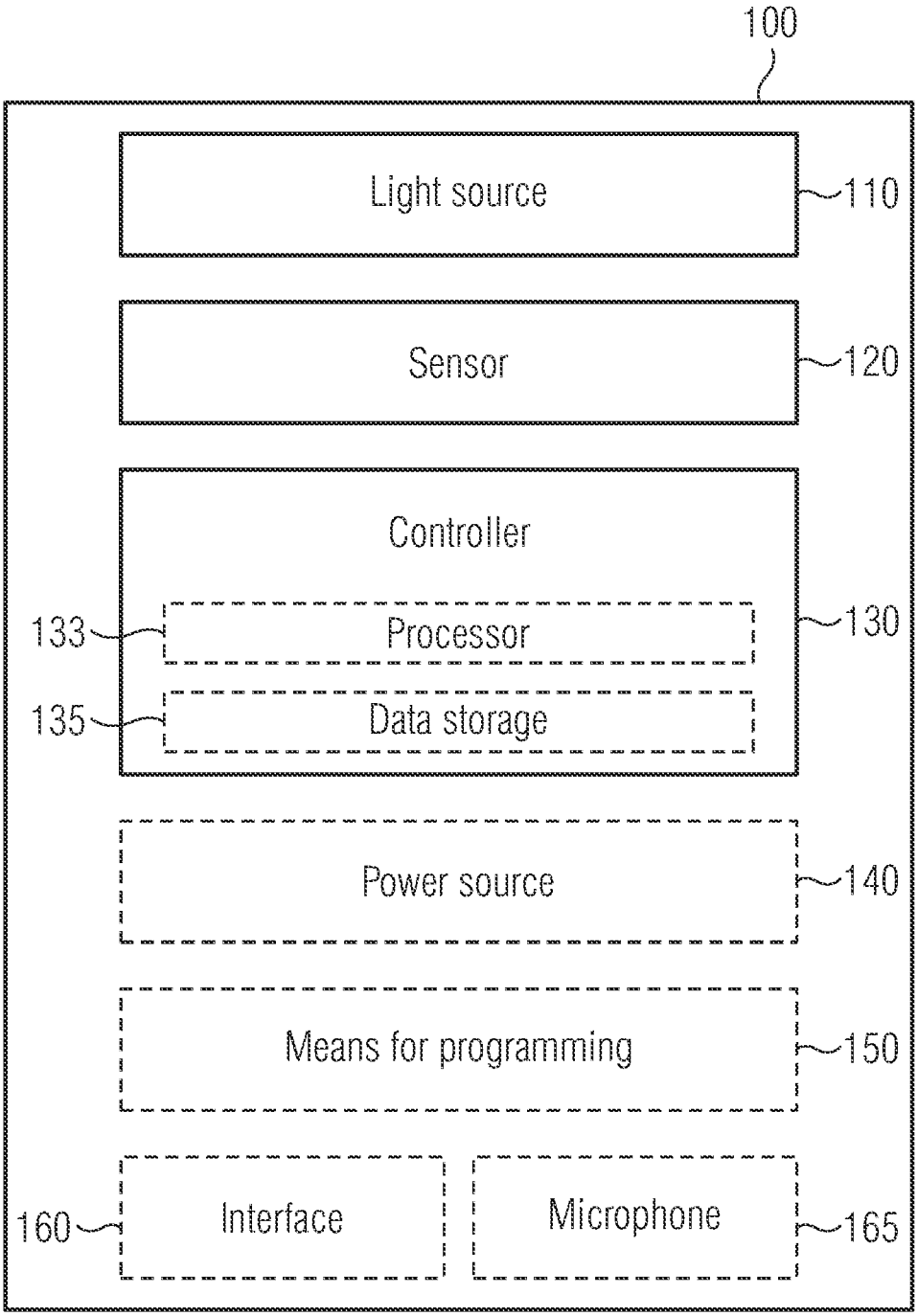
FIG. 1A is a block diagram illustrating a messaging apparatus, according to certain embodiments.

The problems disclosed above are at least partly solved by the embodiments of the present invention. In some embodiments, the messaging apparatus comprises a light source, at least one sensor, and a controller. The messaging apparatus may be embedded in a wearable item, such as apparel, shoes, sports equipment, wearable accessories, and the like. The wearable item may be designed to include a at least one visible element, such as at least one letter, at least one number, a graphical symbol, a design element, and other suitable visible elements. In some embodiments, the light source may not form the at least one visible element. Further, the at least one sensor may be adapted to detect an event.

The controller may be adapted to control the flashing of the light source in response to the detection of the event. The flashing of the light source may be controlled, so that the at least one visible element may be visibly recognized by a viewer. Depending on the embodiment, the viewer may be a spectator or a wearer of the wearable item containing the messaging apparatus or a user of a piece of sports equipment containing the messaging apparatus.

The existing solutions described in the Background section above involve either full display elements or an arrangement of light sources directly representing a letter, a number, graphical symbol or design element. However, certain embodiments of the present invention are based on a fundamentally different approach. For example, certain embodiments of the present invention and may use the motion or action of the person operating or wearing the wearable item to generate an image recognizable by the viewer. The messaging apparatus of the described embodiment comprises a light source, e.g., an arrangement of a plurality of light delivery units. In some embodiments, the plurality of light delivery units do not form the at least one visible element (e.g., a letter, a number, a graphical symbol, a design element, and so on), but rather, the plurality of light delivery units generate or illuminate the at least one visible element in the vision of the viewer through a combination of the appropriate control and the movement of the light source using the effect of "persistence of vision." That is, the light source may not be adapted in the shape of the at least one visible element, but the controlling of the flashing of the light source may form or shape the at least one visible element. To illustrate and only as a non-limiting example, the light source may simply be a thin strip of a plurality of LEDs, which are switched on and off in response to the input from the controller. As this flashing strip is rapidly moved along with the wearable item in which the messaging apparatus is embedded, an image may be formed in the viewer's mind, which leads to the perception of the presentation of a letter, a number, a graphical symbol or design element, etc.

In some embodiments, the actual device generating the light emission is therefore only the fraction of the size of the image displayed. As a result, certain embodiments of the present invention provide for the first time a compact and lightweight device for generating the vision of visible elements, such as letters, numbers, graphical symbols or design elements, on pieces of apparel or sports equipment so that they can be perceived by a spectator watching the wearer, e.g., a professional or amateur athlete, either in real life or in a TV broadcast or by the professional or amateur athlete themselves. In contrast to the existing solutions described in the Background section above, movements of the wearer are not significantly hindered so that there is a negligible effect, if any, on the performance of the wearer.

Further, in contrast to existing rotatable devices equipped with LEDs (as described in the Background section above), the speed of motion and the direction of motion of the wearable item or sport equipment, and therefore, the messaging apparatus is non-uniform and the direction of motion may vary. This can be taken account of in the operation of the controller, which is described in greater detail herein. The controller may therefore control the operation of the light source using either a-priori knowledge of the motion of the wearable item, measurements from a previous operational cycle, or measurements of the current motion of the wearable item. In order to support this operation, the messaging apparatus may include, as non-limiting examples, one or more sensors, motion-sensing devices (such as accelerometers, gyroscopes, magnetometer, inertial measurement units), proximity sensing devices (such as contact switches or proximity sensors), and/or orientation sensing devices (such as inclination sensors). Other suitable sensing devices for determining the motion, position (absolute or relative), orientation or proximity (to other objects) of the wearable item may be used, and thus, the embodiments of the present invention are not limited to the examples described herein. Examples of parameters that may be sensed include the displacement, velocity, deceleration, acceleration or direction of motion (either linear or angular), the total distance travelled, the time passed or distance travelled (either linear or angular) since an impact was detected, the time passed or distance travelled since a step was started, the time passed since a step was completed, proximity to a surface, objects or other persons, the inclination with respect to gravity or position to an external reference, combinations of changes in these parameters or certain patterns in the variation of these parameters to name but a few.

In certain embodiments, the light source may comprise light emitting diodes (LEDs). These diodes may be monochrome or multi-colored. Other light sources can also be used in various embodiments of this invention, such as laser diodes, Liquid Crystal Displays (LCDs), Digital Light Projectors (DLPs), Organic Light Emitting Diodes (OLEDs) or incandescent light sources. The term "light source" should be interpreted in the broadest sense and may not only include devices which generate light, but also devices which reflect or modify light generated by an external source in a controllable manner, for example reflectors, retro-reflectors, filters, tunable filters or absorbers to name but a few. In addition to switching the light source on and off it is also possible to control the image by changing the emission, absorption or reflection of light in a more continuous manner or by changing the arrangement or alignment of the light source, e.g., by tilting the light source, reflective or absorbing elements.

In certain embodiments, the LEDs may be surface-mounted LEDs on a printed circuit board (which can be either flexible or rigid). Moreover, in some embodiments, the light source may have a length in one dimension in the range of approximately 1 cm to 10 cm. In some embodiments, the light source may have a length in one dimension in the range of approximately 1 cm to 5 cm. In some embodiments, the light source may have a length in one dimension in the range of approximately 1 cm to 3 cm. Such LEDs may facilitate an improved presentation of letters, graphical elements and design elements, while maintaining a light weight and mounting flexibility.

In certain embodiments, the light source may be a plurality of light delivery units that are arranged in one linear row. Alternatively, they can be arranged in an arc or circular arrangements. It will be appreciated that the plurality of light delivery units may be arranged in any arrangement or pattern. Additionally, arrangements of multiple rows, multiple arcs or other two-dimensional arrangements can be used. Arranging the light source in multiple rows may allow static images to be displayed in addition to or in combination with the "persistence of vision images" which relying on the movement of the messaging apparatus. Further, using multiple rows of light sources may reduce the threshold speed required for the display of the "persistence of vision" image.

In certain embodiments, the messaging apparatus may be configured to display a message, image, logo, pattern, or any visible element in response to an event. As a non-limiting example, this event can be the wearer (e.g., the professional or amateur athlete) achieving a certain target (e.g., reaching a certain speed, jumping at a certain velocity or to a certain height, kicking or throwing a ball with a certain force or scoring a point or goal). In some embodiments, the event can be the wearable item (e.g., the piece of apparel or sport equipment) achieving a characteristic motion, performance target or threshold condition, for example, relating to a displacement, a speed, an acceleration or an impact, achieving a certain pattern in the variation or changes in these parameters or a combination thereof. In some embodiments, the event can be the spectator triggering the display by the messaging apparatus using a remote control or setting targets to be achieved by the wearer, thereby allowing the spectator to interact with the wearer and the wearer's wearable item. In some embodiments, the event could also be, that the switch is ON/OFF. In addition, the event can be the combination of any of the aforementioned events, or an event not described in the examples provided above.

In certain embodiments, the messaging apparatus may be adapted to initiate the flashing of the light source to create the visible element (e.g., a message, image, logo or pattern) when a threshold velocity condition is satisfied. For example, the threshold velocity condition may be satisfied when the messaging apparatus reaches a threshold velocity value. In some embodiments, the flashing may only be initiated when a certain acceleration condition is satisfied. For example, the acceleration condition may be satisfied when the messaging apparatus reaches a certain acceleration value. In some embodiments, the threshold acceleration value may be in a range between approximately 1 g to 5 g, between 1 g and 3 g, or between 1.5 g to 2.5 g. In certain embodiments, if the flashing is initiated after such threshold acceleration values are determined, the velocity of the movement of the piece of apparel, such as a shoe can be estimated and the frequency of the flashing can be optimized to present whole words and/or graphical elements. Moreover, displaying messages only when certain threshold acceleration or velocity values are reached may avoid unnecessary flashing of the light source so that the power consumption may be reduced and the spectators are not overly disturbed or distracted.

In some embodiments, the at least one sensor in the messaging apparatus may be further adapted to determine a direction of a motion and the operation of the light source may be adapted accordingly. Sensing a direction of motion of the messaging apparatus may, for example, enable words, numbers or logos to be displayed so that they can be read or recognized by viewers.

In some embodiments, the controller may be adapted to initiate the flashing if the determined direction of the motion is similar to or recognized as one or more predetermined directions, or follows a certain or pre-determined movement pattern. Such embodiments follow the same idea as described above, namely to avoid an unnecessary flashing, and thus, to reduce the power consumption and/or any distraction of other wearers and spectators. For example, only if the determined direction of the motion is similar to or recognized to be one or more predetermined directions, which will be further explained below, then the light source may be controlled by the controller to illuminate or generate the visible letters, graphical elements or design elements. This allows a more selective way to initiate the flashing of the light source, so that the message display may be coupled to the movement of the piece of apparel or sport equipment, in particular a shoe such as a sport shoe.

In some embodiments, the predetermined direction may correspond to shooting a ball. Moreover, the predetermined direction may correspond to a jump of a wearer of the piece of apparel or sport equipment. It may also be related to a racket or bat following a predefined or optimal movement path. Displaying messages when these movements are achieved can indicate "success", for example, the achievement of a certain goal or a pivotal or important action in the game/sport to a spectator or wearer. If the flashing is initiated for such movements, the messaging unit may consume as little power as possible and might not have to be charged during a game, a training session and/or several games or training sessions.

The messaging apparatus may be further adapted to control the frequency of the flashing depending on an acceleration value or measurement of the determined direction of the motion to control the flashing or, more generally, the image of the letters, numbers, graphical elements, or design elements. In some embodiments, the assumed, derived or determined speed of movement may also be used. Such a messaging apparatus may provide an even better approach for presenting letters, graphical elements, or design elements. For example, the controller may compute the velocity of the wearable item, so that dimensions of the letters, graphical elements or design elements are optimized for presentation. Therefore, the messaging apparatus may provide a higher resolution and may reduce any distortions of the presented items.

Furthermore, in some embodiments, the messaging apparatus may tune the display of the at least one letter, at least one number, graphical symbol or design element in response to an event by adapting the flashing pattern of the light source in such a manner that it is optimized for capturing the display on photographs, for TV recordings or in videos.

The messaging apparatus according to the invention may further comprise a means for programming (e.g., a programmable device, such as a processor) the at least one letter, graphical symbol or design element. For example, the controller of the messaging unit may comprise a processor and data storage, wherein instructions may be stored for flashing the light source so that the letters, graphical elements or design elements may be displayed as explained above. The instructions may provide a programming scheme used by the processor of the controller for translating the letters, graphical symbols or design elements into a sequence of flashes to create the persistence of vision image of the letters, numbers, graphical elements, or design elements.

In some embodiments, the messaging apparatus may further comprise an interface for externally programming the at least one visible element (e.g., at least one letter, graphical symbol or design element). The interface may be coupled wirelessly or by a cable to the messaging apparatus. Accordingly, a wearer of the sport equipment, wearer of the shoe, spectator, or any individual may program the items to be displayed. In addition, in some embodiments, other parameters are also externally programmed, such as the motion and event parameters used to trigger and control the display, for example, the threshold velocity, acceleration or the predetermined direction explained above. For example, the messaging apparatus may be adapted to provide or accept a plurality of predefined profiles, such as "soccer", "basketball", "American football", and so on, which can be easily selected by a wearer, and then define what is displayed and under what conditions.

In some embodiments, the controller may be further adapted to initiate the flashing of the light source depending on the reception of an additional external signal. Such embodiments may provide the possibility that the display of additional information or design elements becomes even more selective as an additional external signal may initiate the flashing. For example, another person, such as a live director on TV, or a computer program may cause to transmit wirelessly an additional external signal to the messaging apparatus, for example, if a soccer player performs a certain movement, such as a shot or a long pass. These embodiments selectively enrich the presentation of the game for a real spectator and/or a spectator in front of a TV or a smartphone/mobile device. In some embodiments, the flashing of the messaging apparatus may depend on the combination of the receipt of an external signal and the achievement of an event or performance target.

In some embodiments, the controller may be further adapted to track the running distance and/or speed of a wearer of the piece of apparel or sport equipment by using the at least one sensor. Such embodiments provide a dedicated messaging apparatus for presenting information about the wearer to spectators in a stadium or in front of a TV or a smartphone/mobile device.

As non-limiting examples, the message visible by the viewers may be a simple indication of an event, may characterize the event, describe information relating to the event communicate information related to the event, such as advertisements, details about the wearer, performance details, decorations or artistic expressions to name but a few.

In some embodiments, a soccer shoe is provided which comprises a messaging apparatus. When the soccer player shoots a ball, the messaging apparatus in the shoe may present the speed of the ball or the name of the soccer player in order to provide information about the shot and/or the soccer player.

As another non-limiting example, the design elements, such as red and yellow flames, may be displayed by such a messaging apparatus in order to indicate that a certain shot is exceptionally strong. Moreover, such threshold acceleration values may avoid unnecessary flashing of the plurality of light sources so that the power consumption may be reduced and the spectators are not overly disturbed or distracted.

In some embodiments, the messaging apparatus may be incorporated into pieces of wearable items (e.g., apparel, such as sport shoes, sports clothing, shirts, sleeves, pants, jackets or sports equipment worn or used by a professional or amateur athlete, such as helmets, gloves, rackets, for example for tennis, badminton or squash, bats, for example for baseball, cricket or table tennis, golf clubs, sticks, such as sticks used for ice-hockey, balls, skis, snowboards, surfboards, kites, bicycle or other suitable objects. The embodiments of the present invention are not limited to the examples of wearable items described above.

In some embodiments, the messaging apparatus may be incorporated or fixed to the piece of apparel or sport equipment in a permanent manner. In some embodiments, the messaging apparatus may be detachable.

The elements of the wearable item comprising the messaging apparatus may be located in one compact unit. In some embodiments, the components are distributed in separate locations. Arranging the elements in distributed manner may be beneficial to allow displaying the message from a different location than the position of the sensor or controller. It is therefore possible to optimize the detection of the event triggering the message display by locating the sensor in an optimal location while allowing the message to be generated in and viewed from an optimal location or angle either by a spectator or the wearer. If parts of the messaging apparatuses are positioned in different locations, these parts can communicate either by wired or contact-less communication methods, such as Bluetooth, Bluetooth low energy (BTLE), ZigBee, nearfield communication (NFC), Wi-Fi and other suitable communication approaches.

In some embodiments, the present invention relates to a wearable item comprising a messaging apparatus, as described above. Moreover, non-limiting examples of the wearable item may include a shoe, in particular a sports shoe, a garment or a wearable accessory. In the case of a shoe, the messaging apparatus may be arranged on a lateral side of the shoe. Furthermore, the messaging apparatus may be arranged in a heel part of the shoe. Such arrangements of the messaging apparatus enhance the presentation of letters, graphical elements or design elements to spectators in a stadium or in front of a TV or a smartphone/mobile device. The lateral side represents the side facing to spectators. Moreover, the heel part represents the part of the shoe which is least used when shooting ball, and thus, certain embodiments arrange the messaging apparatus in the heel part of the shoe. Embodiments of the present invention are not limited to the examples described above, and as such, it has to be noted that any other part of the shoe may comprise a messaging apparatus according to embodiments, such as the medial side, forefoot part, midfoot part, instep part, and so on.

In some embodiments, the messaging apparatus may be integrated into a shoe without laces. As a result, disruptive covering of the laces over the light source may be avoided so that the letters, numbers, graphical elements or design elements can be clearly recognized.

In some embodiments, the messaging apparatus may also be arranged so that it can display information, numbers, letters, symbols or design elements to the wearer. This display may provide information about the current performance, give feedback, encourage a certain action or attempt to motivate the athlete. It may also provide information about the surroundings, such as the weather, air conditions, state of play, location of other players and so on.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Possible embodiments and variations of the present invention are described below with particular reference to a soccer shoe. However, the concept of the present invention may identically or similarly be applied to any sports shoe used for movements with sufficient speed, such as for running, basketball, rugby, American football, cycling and athletics, in particular sprinting, high jumping, pole jumping as well as other kinds of athletics and any other team sports. Moreover, the principle underlying the present invention may also be applied to any shoe, such as casual shoes in lifestyle situations or safety shoes like working boots. Furthermore, the principle underlying the present invention may also be applied to any sport equipment such as a ball, for example, a ball for soccer, rugby, American football, basketball, baseball or to a piece of sports equipment, such as a tennis racket, golf club, baseball bat, badminton racket, cricket bat, ice-hockey stick, hockey stick, squash racket, table-tennis bat, boxing gloves, ski, snowboard, kite, and so on.

Moreover, for brevity only a limited number of embodiments are described in the following. However, the skilled person will recognize that the specific features described with reference to these embodiments may be modified and combined differently and that certain aspects of the specific embodiments may also be omitted. Moreover, it is noted that the aspects described in the subsequent detailed description may be combined with aspects described in the above summary section.

Figure 1B:
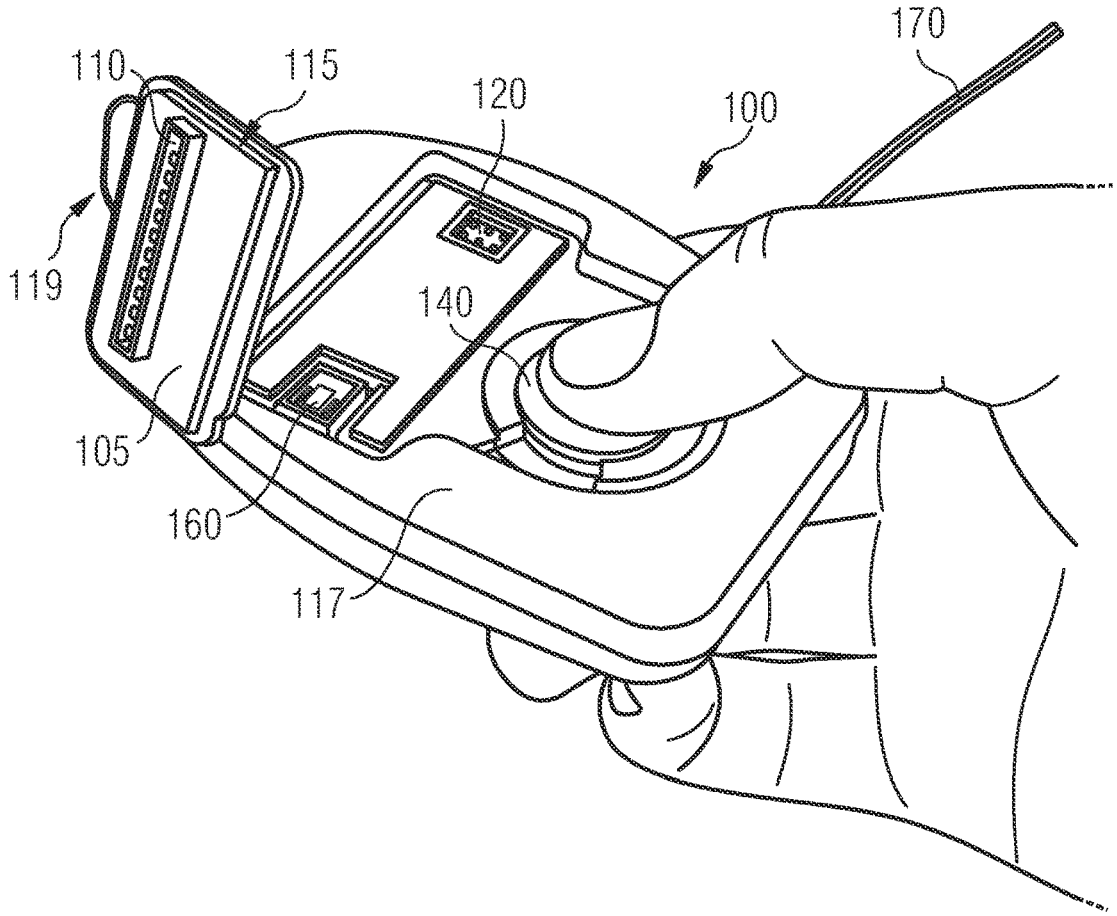
FIG. 1B is a perspective diagram illustrating a messaging apparatus, according to certain embodiments.

FIG. 1A presents a schematic representation of one particular embodiment of a messaging apparatus 100 for a wearable item, such as a piece of apparel or a soccer shoe, for presenting at least one visible element (e.g., at least one letter, at least one number, graphical element or design element) according to embodiments of the present invention. An example of such a messaging apparatus is shown in FIG. 1B. In the schematic embodiment of FIG. 1A, the messaging apparatus 100 comprises a light source 110, wherein the light source does not form the at least one letter, does not form the at least one number, does not form the graphical symbol, and does not form the design element. For example, the light source is not in the shape of the visible element, but rather, the light source may be a plurality of light sources. The light source 110 may be Light Emitting Diodes (LEDs), Liquid Crystal Displays (LCDs), Digital Light Projectors (DLPs), Organic Light Emitting Diodes (OLEDs), incandescent light sources, electrochromic devices and the like, which may be arranged in one or more rows.

As shown in the exemplary embodiment of FIG. 1B, the light source 110 in this particular example comprises eleven surface-mounted LEDs arranged approximately equally spaced in one row on a printed circuit board for flashing so that at least one letter, at least one number, graphical symbol or design element may be displayed. In some embodiments, the row in this example is about 5 cm long to fit with the dimensions of the soccer shoe as shown in FIG. 2B. This number and arrangement provides a good compromise for this application between an improved presentation of letters, graphical elements and design elements and a low weight and small size for easy integration into the shoe (not shown in FIG. 1B), so that the movements of a wearer of a shoe are not negatively affected.

In the schematic embodiment of FIG. 1A, the messaging apparatus 100 may comprise at least one sensor 120 adapted to determine a relevant parameter, for example, an acceleration of the messaging unit 100 and the associated sport equipment, such as the moving shoe. In the particular example shown in FIG. 1B, this sensor is a three-axis accelerometer which is configured to detect the acceleration along the length axis of the shoe. In some embodiments, other sensors may be used, such as a gyroscope, a magnetometer, and so on, as mentioned above.

Moreover, the messaging apparatus 100 may comprise a controller 130, which may be connected to the at least one sensor 120 and to the light source 110. The controller 130 may be adapted to control the flashing of the light source 110 (e.g., the flash operation of the light source) so that the at least one letter, at least one number, graphical symbol or design element may be displayed when the messaging unit is moving as explained above. For example, controlling the flash operation of the light source may include turning on and off the light source in quick bursts. The flash operation of the light source may be the capability of the light source to turn off and on quickly, thereby mimicking a flash. Furthermore, the controller 130 may comprise a processor 133 and data storage 135. In the particular example shown in FIG. 1B, this controller is a micro-processor with associated program and data storage.

The processor 133 may be adapted to initiate the flashing of the light source 110 when a threshold acceleration value is reached, wherein the threshold acceleration value may be in a range between 1 g to 5 g, in some embodiments, between 1 g and 3 g, and in other embodiments, between 1.5 g to 2.5 g. Detecting this threshold acceleration will ensure that the messaging apparatus is moving at a sufficient speed to display a recognizable image to the viewer as shown in FIG. 2C and FIG. 2D.

As shown in the schematic embodiment of FIG. 1A, the messaging apparatus 100 may further comprise a power source or energy storage device 140. In the particular example shown in FIG. 1B, this power source is a battery, more precisely two-coin cell batteries with a voltage of about 3V (CR2016) for supplying power for the LEDs 110, the controller 130 and the at least one sensor 120. It is also possible to use any other power source as known in the art such as disposable or rechargeable batteries, lithium ion batteries, energy harvesting elements, piezoelectric systems, capacitors and the like.

The power source may also be linked to an on/off switch (not shown in FIG. 1B) which allows the power source to be disconnected from the rest of the circuit, for example when the unit is in storage. The switch may be a manual switch, capacitive switch, rotary switch, toggle switch, knife switch, press buttons or any other suitable switch that can break an electrical circuit, interrupting the current or diverting it from one conductor to another.

In this particular example, the switch is coupled to the housing 117 by a flexible wire 170. Such a switch may allow to switch on/off the messaging apparatus 100. Thus, a wearer, e.g. a professional athlete, may switch on the messaging apparatus 100 before a public game so that from that point in time messages relating to certain movements are displayed. Moreover, in some embodiments, there might be a function to perform an automatic wake-up where the messaging apparatus 100 stays in a sleeping/low power mode and will be activated via a specific movement or action of the wearer or by an external event or signal such as a particular tone (e.g., clapping).

The messaging apparatus 100 may also comprise a programming device 150 and interfacing 160 the unit to external equipment for recharging, powering or programming. In the example shown in FIG. 1B, the wearer is able to reprogram the symbols, graphic, letter(s), number(s) or design elements to be displayed using a computer or smartphone which interfaces with the messaging unit using a USB port as the interface 160. The USB port is cheap, easy to use and provides a common standard to operate with a variety of external devices such as a computer, laptop, smartphone or the like. In addition, such an interface 160 may further reduce the power consumption as the power is only used by the controller for presenting the letters, graphical elements or design elements. The wearer is able to use a computer program or app to pre-select display elements from a preprogrammed library or to create their own design elements.

In some embodiments, the messaging apparatus 100 may also comprise at least one microphone 165 for detecting external signals, such as a certain tone or clapping, certain commands by the wearer or observer, and an activation as mentioned above.

In the particular example shown in FIG. 1B, the controller, power source and programming interface are arranged on a common printed-circuit board (pcb). The light source may be arranged on a separate pcb which is linked to the controller using a ribbon cable.

The exemplary embodiment of the messaging apparatus 100 for presenting at least one letter, at least one number, graphical elements or design element according to the present invention shown in FIG. 1B comprises an essentially rectangular shaped housing 105 for the light source 110. The form of the housing 105 is not limited to a certain geometry and may be adapted for easy integration into a shoe or any other piece of apparel, as will be explained further below.

Moreover, the housing 105 may comprise an attachment unit 115 for attaching it to a piece of apparel such as a shoe. In the embodiment of FIG. 1B, this may be a series of holes (too small to be shown in FIG. 1B) arranged on the edge of the housing 105 so that it may be stitched to an inner surface of the shoe. In some embodiments, the attachment unit 115 for attaching may be a hook and loop fastener, a press button, a zipper, a magnet or any other appropriate means or device for attaching. Moreover, in some embodiments, the housing 105 may be welded, glued and the like to a shoe. A removable attachment allows the replacement of the light source, such as a defective set of LEDs, or to exchange the light source by another set in a different housing, for example to display different letters, numbers, symbols or design elements.

In the exemplary embodiment of FIG. 1B, the housing 105 may comprise a flat rear surface. This flat rear surface may be used to bond the housing 105 to the material of the shoe on the inner surface of a shoe. Such bonding of the housing 105 may further improve the presenting of letters, numbers, graphical symbols or design elements as the housing 105 may be securely placed inside a shoe. In some embodiments, the surface of the housing 105 may be flexible so that it can adapt to the contour of the surface of the shoe where the housing 105 will be attached. The outer surface of the housing 105 might be slightly convex so that the housing 105 can be easily integrated into a convexly shaped outer surface of the heel part of a shoe. In another embodiment of the invention, the outer surface of the housing 105 is shaped to match, fit to or enable easy attachment to the corresponding surface of the piece of apparel or sports equipment.

As can be seen in FIG. 1B, the messaging unit 100 may further comprise another housing 117. The housing 117 may contain components such as at least one sensor 120, controller 130, power source 140, wherein the power source 140 may also be placed externally, data storage, programmable device 150 and interface 160. Other arrangements can easily be arranged and will be obvious to those trained in the art of designing electronic systems. Moreover, the housing 117 may also contain less or more components as here mentioned. The controller may be adapted to control the flashing of the light source 110 so that at least one letter, at least one number, graphical symbol or design element may be displayed by a movement of the shoe due to the persistence of vision effect as explained above. In this particular example the connection between the housing 117 including the controller and the housing 105 including the light source 110 may be a cable 119. In some embodiments, a wireless connection, such as for example Bluetooth, may be used.

Generally, if LEDs may be used as light source, they are cheap, durable and easy to use. In some embodiments, other appropriate types of light sources may be used such as Liquid Crystal Displays (LCDs), Digital Light Projectors (DLPs), Organic Light Emitting Diodes (OLEDs), incandescent light sources, electrochromic devices and the like. In the context of this invention, the term "light sources" should, however, be interpreted in the broadest sense and may also include devices which reflect, absorb or modify light generated by an external source in a controllable manner, for example reflectors, retro-reflectors, filters, tunable filters or absorbers to name but a few. For example, another embodiment controls the display of the image by changing the reflection of light shown onto the messaging unit. The light source may be mono-chromic. In some embodiments, multicolored light sources may be used to generate colored displays.

If the light source comprises a plurality of light units, the number of the light units used for display purposes in the messaging unit 100 may depend on the size of each single light source, the length of the arrangement, the space and weight requirements of the application, the complexity of the symbol, graphics, logo, image, number, letter or message to be displayed or the display and presentation requirements. Moreover, in some embodiments, the light source 110 will depend on the application and may have a length in one dimension in the range of approximately 1 cm to 20 cm, 1 cm to 10 cm, 1 cm to 5 cm and 1 cm to 3 cm. The ranges described here are examples, and thus, the embodiments of the present invention are not limited thereto.

In addition to switching the light source on and off, the light sources may be controlled in a more continuous manner, by changing their color, by changing the light intensity or by changing the arrangement or alignment of the light source, for example, by tilting the light sources, reflective or absorbing elements.

In the embodiment shown in FIG. 1B, the light units are arranged along a straight row and are equally spaced. However, those trained in the art will easily recognize that many other arrangements can be employed. For example, the light source can be arranged in arcs or other circular elements, in multiple rows or other one-dimensional and two-dimensional patterns. Furthermore, the light source may all be located in the same housing 110 or in one or more further housings (not shown), which can be used to display the letters, numbers, graphical symbols or design elements. These further housings may be located in other positions on the piece of apparel or sport equipment, for example, in order to display symbols, graphics, logos, images, numbers, letters or messages from multiple locations. These multiple housings may display the same symbols, graphics, logos, images, numbers, letters or message or alternatively display different symbols, graphics, logos, images, numbers, letters or messages, when an event occurs. Additionally, some of these multiple housings may display symbols, graphics, logos, images, numbers, letters or message, while others do not flash, when a particular event occurs. The controller 130 may be configured to operate the light sources in the multiple housings and optimize the display of symbols, graphics, logos, images, numbers, letters or message depending on the location of each unit.

A large variety of sensors may be used to trigger the message display by the messaging apparatus. Examples include one or more one-axis or multi-axis accelerometer(s) to measure the acceleration of the messaging unit 100 and therefore shoe or to derive the velocity or displacement of the messaging unit or shoe, one-axis or multi-axis gyroscope (s) to measure angular acceleration or derive angular velocity or displacement, inertial measurement unit(s) to determine the position and orientation, inclination sensor(s) to determine the angle of the unit with respect to the direction of gravity, proximity sensor(s) to detect, for example, the proximity of the ground or other object, contact switch or impact sensor(s) to detect impacts, for example between the foot and the ground during the running motion, step counters, GPS unit(s) and so on or combinations thereof. In addition, measurements may include the timing of one or more characteristic event(s), for example the landing or push-off of a foot during a running stride or contact with a ball, or the time passed since a characteristic event occurred. Other examples can be used in these embodiments.

The controller 130 may process the information from the sensors and may trigger the display of the image in response to this input. In some embodiments, the controller may determine the linear speed of motion of the foot and may trigger the display once a threshold speed is reached, for example, a speed between 1-15 m/s, such as 5 m/s. The threshold described here is exemplary, and thus, the embodiments of the present invention are not limited thereto.

In a further example, a gyroscope is used to derive the angular velocity of the shoe and display an image once the angular velocity has exceeded a certain threshold speed between 50-600°/s, for example, 300°/s. The threshold described here is exemplary, and thus, the embodiments of the present invention are not limited thereto.

The controller may adapt the frequency and pattern of flashing based on the position, orientation, velocity or acceleration of the messaging apparatus and therefore shoe in order to present whole words and graphical elements as shown in FIGS. 2C and 2D or to change the flashing pattern of the light source 110, for example, to the optimize the display for the viewing angle of the spectator or the wearer, e.g. the athlete.

Furthermore the controller may use measurements of the direction of movement to determine the flashing pattern of the light source 110, for example to ensure that the patterns, design elements, symbols, numbers, letters or images are displayed in the correct orientation and/or in a readable or recognizable manner.

In some examples, the controller has been programmed with a-priori knowledge of the stride pattern of the wearer. Based on the detection of the landing or push-off of the foot during the running motion, the controller can predict the speed, position and angle of the foot and adjust the timing and pattern of the flashing of the light source to generate the display accordingly. The a-priori knowledge used to program the controller may be based on data from the wearer using the shoe or may be based on data derived from a larger group of wearers. It may be programmed into the unit during manufacture or at the point of sale, by the wearer prior to engaging in the sport session or may be based on measurements taken by the messaging apparatus in previous sessions, during an earlier time interval or during the current session. For example, if the wearer is an athlete, the messaging apparatus may measure the athlete's previous running stride and base its display in the current stride on these measurements. In some embodiments, instead of programming the controller with a-priori knowledge of the stride pattern of the wearer, a programming, or in other words a calibration, can be done by the wearer or athlete himself. This kind of calibration can be triggered by the wearer and can be started and/or ended by pressing a switch or using an application which is installed on a smartphone or mobile device.

In some examples, the controller derives the orientation of the shoe with respect, for example, to gravity and triggers the image display based on this orientation measurement.

The image display may also be triggered by an external event. In some embodiments, a spectator or observer instructs the controller to trigger the flashing of the arrangement of the plurality of the light sources 110. For example, a spectator or an observer may trigger the flashing of the light source via a smartphone or another mobile device over a wireless connection (e.g. Wi-Fi, Bluetooth, BTLE, GSM, UMTS, LTE, NFC connection) or via certain voice commands or clapping which will be recognized by a build-in microphone. As another example, the flashing is triggered by the applause of a plurality of spectators e.g. in a stadium, which will be recognized by a built-in microphone. As another example, the flashing is triggered by an external optical signal, which can be recognized by a photodiode or any suitable detector, or by changes in the ambient light conditions or illumination.

Moreover, the controller 130 may be adapted to initiate the flashing of the light source 110 (e.g., control the flash operation of the light source) depending on the combination of the occurrence of an event and the reception of an additional external signal. Thus, the display of additional information or design elements may become even more selective, as the additional external signal may be needed to trigger the flashing. Furthermore, the spectator or observer may be able to adjust the settings and event detection settings and trigger points of the messaging apparatus 100 using one or more external signals while the messaging apparatus is in use. The additional external signal may be received wirelessly by one or more antenna using for example one of the common standards for wireless transmission such as Wi-Fi, Bluetooth, GSM, UMTS, LTE, NFC and the like.

If a multi-axis accelerometer is used as the sensor 120, the accelerometer may be adapted to determine a direction of the acceleration. For example, the accelerometer may use one to three axis corresponding to Cartesian coordinates in order to determine one to three physical directions of the acceleration. Thus, if only one axis may be used, the sensor 120 may determine the direction of the acceleration along this single axis. In some embodiments, the axis may be pre-calibrated so that a deviation to this axis may be determined. In some embodiments, the accelerometer may deduce the direction of gravity from the measurements made.

In some embodiments, the sensor element 120 of the messaging apparatus may include several sensors to allow more precise, complete or complex data to be collected in order to better characterize the movement or detect more complex movements or events or additional events (which can, for example, not be detected by a single sensor), trigger and control the flashing of the light source 110. For example, the sensor 120 may contain an accelerometer and at least one gyroscope to determine, for example, an orientation of the accelerometer 120 with respect to the Earth's gravity.

In some embodiments, the controller 130 may be adapted to initiate the flashing if the determined direction of motion or acceleration is similar or recognized to one or more predetermined directions. Thus, for example, the flashing may only be initiated for predetermined movements, such as shooting a ball and/or a jump. It is also possible that any other movement may be determined by certain acceleration values associated to certain directions.

While in many scenarios, the letters, numbers, symbols or design elements to be displayed may remain the same, the messaging apparatus may display different patterns, design elements, symbols, numbers, letters or images when different events or movements are detected. In some embodiments, the displayed content is dynamically changed either internally or based on external signals received by the messaging apparatus. For example, different numbers are displayed if different threshold velocities are reached. In another example, different messages are displayed when different movements patterns are detected, for example, a threshold speed is reached or a shot is taken. Similarly, the estimated or measured height of a jump of a basketball player could be immediately displayed during the jump. Furthermore, in case of a soccer player, a measured maximum velocity of a ball after a shot may be immediately transmitted to the messaging apparatus by an external unit or instrument and then be displayed for the benefit of the spectators.

Data relating to such predetermined movements or events may be stored, for example, in the data storage 135, and may be received or downloaded from another unit as a part of one of a plurality of predefined and selectable profiles, such as "soccer", "basketball", "American football", etc. For example, the profile "soccer" may contain data, which if the profile is selected enable the processor to identify shoe movements corresponding to strong shots or long passes of a soccer player. By contrast, the profile "basketball" may contain data to identify shoe movements corresponding to typical jumps as they occur in basketball when a point is to be scored. The identification of a certain movement and thus the initialization of the flashing may additionally or alternatively depend on other sensors attached or integrated into the shoe or in communication with the messaging apparatus 100.

The patterns displayed by the messaging apparatus may be pre-determined patterns, design elements, symbols, numbers, letters or images or they may provide direct or additional information about the current situation and performance of the wearer. For example, they may provide information about the speed of motion, number of steps taken, distance travelled and so on. For example, in some embodiments, the messaging apparatus displays the speed of motion when the wearer takes a sprint. In another example, the color and width of a stripe displayed after a shot is indicative of the speed of the shoe during the ball strike.

The messaging apparatus 100 may further contain a programmable device 150 (e.g., means 150 as shown in FIG. 1A) for programming the at least one letter, graphical symbol or design element. For example, the processor 133 may use stored instructions in the data storage 135 for flashing the light source 110 so that the letters, numbers, graphical elements or design elements may be displayed as explained above. The instructions may provide a coding scheme used by the processor 133 of the controller 130 for translating the letters, graphical symbols or design elements into flashing, which man refer to, determining the frequency and diode selection for flashing.

The messaging apparatus 100 may further comprise an interface 160 for externally programming the at least one letter, at least one number, graphical symbol or design element. The interface 160 may be coupled wirelessly or by a cable to the messaging apparatus 100 and may communicate with the processor 133. Accordingly, the items to be displayed may be programmed. This will be explained in more detail in FIG. 1C.

The example shown in FIG. 1B uses a USB port as interface 160 for programming as discussed above. In some embodiments, the interface 160 may be wireless, e.g. Wi-Fi, Bluetooth, BTLE, GTM, UMTS, LTE and the like. For example, the wearer may set up a WLAN link to the messaging apparatus in order to program the one or more letters/symbols/design elements to be displayed by means of an app running on a smartphone/tablet computer or any other app enabled mobile device. This is a particularly convenient way for any wearer and may allow them to quickly change the items to be displayed by the messaging apparatus. Such an app could also be used to run some testing routines to verify a proper operation of the messaging apparatus and/or to detect malfunctions such as a defective light source.

In addition, in some embodiments, other parameters may also be selectable or externally programmable, such as the threshold acceleration value and the predetermined direction as explained above. As explained above, the unit may be adapted to provide or accept a plurality of predefined profiles such as "soccer", "basketball", American football, which can be easily selected by a wearer and then define what is displayed and under what conditions.

The messaging apparatus 100 may comprise one or more batteries as a power source 140, as shown in FIG. 1B, for supplying power to the light source 110, to the controller 130 and to the sensor 120. In some embodiments, a range of other power source are available to provide power to the messaging apparatus 100. Such embodiments include capacitors, fuel cells or energy generators, which generate energy, for example, from the movement of the wearer, based on at least one piezo element or the like, from temperature differences and heat generated by the wearer or the environment, using, for example, thermopiles, or from light, using, for example photovoltaic cells, or other energy generating systems, for example, clockwork type mechanisms which can be charged by the wearer. Such generators may be used to provide part or all of the energy required to power the messaging apparatus 100, thereby reducing the size of the energy storage device required for the operation of the messaging apparatus 100 or alleviate the need for such an energy storage device (e.g. a battery) all together. In some embodiments, they can be used to charge any energy storage device used in the messaging apparatus 100. Any battery used may be non-rechargeable or rechargeable. Recharging can occur in a number of ways known to those trained in the art, including wired or contactless charging techniques (e.g. via USB, NFC, inductive charging).

In order to enable management of the power consumption, the messaging apparatus may include a switch as mentioned above which enables the power to the apparatus to be switched on and off. In some embodiments, the controller 130 enters into a low power mode after a certain period of inactivity, for example, when no movement is detected after a certain period of time, for example of the order of several minutes. In addition, the messaging apparatus can wake-up again and switch from this low power mode into its normal mode of operation when movement is again detected by the controller 130. In some embodiments, the switch may be controlled wirelessly. In yet other embodiments, a plurality of messaging apparatuses, for example for all players of a team, may be activated by a single broadcast wireless signal. Furthermore, the power source or batteries 140 may supply power only when they are pressed together and pressed to a contact. For example, if the messaging apparatus 100 may be arranged below an insole in the heel part of a shoe, the flashing of the light source 110 may be only activated, but not initiated, if a foot is placed inside the shoe. Therefore, the pressing together of the batteries or battery to contact may act as an activation switch control and the power consumption due to unnecessary flashing of the messaging apparatus 100 may be reduced. Another option may be to have an automatic wake-up function as explained above.

In addition to displaying at least one visible element, such as a letter, at least one number, graphical symbol or design element in response to an event, the messaging apparatus may also display a "normal" graphic or image in addition to the "persistence of vision" image. The messaging apparatus 100 may light up or flash the light source to create a pattern, similar to the static logo, color elements or advertisement on a shoe; when an event is detected, the messaging apparatus can then change this flashing pattern to display the at least one letter, at least one number, graphical symbol or design element using the movement of the messaging apparatus to generate the "persistence of vision" image.

The messaging apparatus shown in FIG. 1B is integrated into a shoe. This integration is further explained below with reference to FIGS. 2A-2D.

Figure 1C:
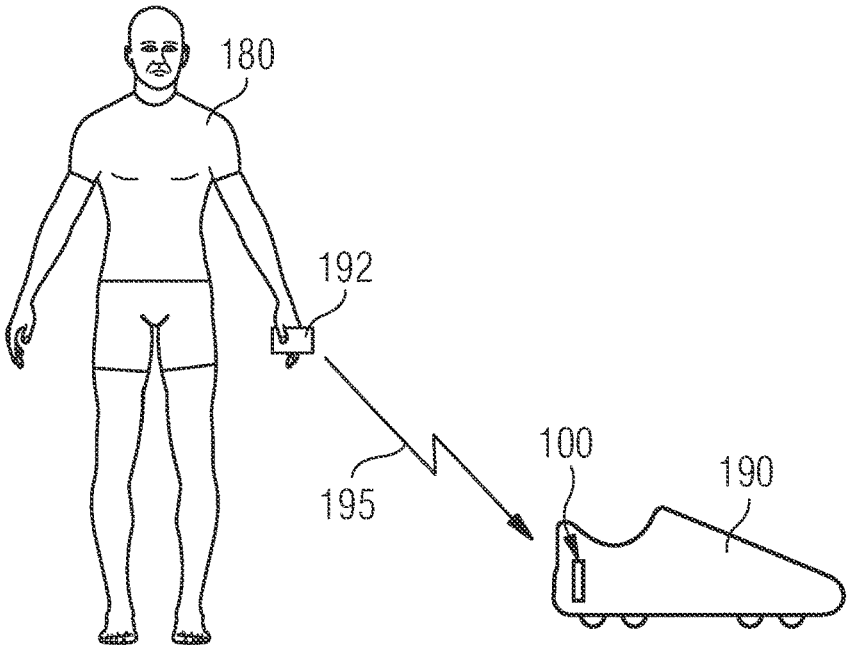
FIG. 1C is a diagram illustrating a messaging apparatus for a shoe, according to certain embodiments.

FIG. 1C presents a schematic embodiment of the messaging apparatus 100 integrated into a piece of apparel 190, such as a soccer shoe, wherein the messaging apparatus 100 may be coupled wirelessly with a remote controller 192, such as a smartphone or any other suitable mobile device, of a viewer 180 such as a wearer of the shoe 190 or spectator via a wireless connection 195 as mentioned above. The viewer 180 may be able to program or update the messaging apparatus 100 via the remote controller 192 over the wireless connection 195 The programming or updating may be done via an installed application on the remote device. The messaging apparatus 100 may be activated by automatic motion as mentioned above but may also be manually triggered by the viewer 180, maybe also via the remote controller 192 over the wireless connection 195. For example, if the viewer 180 is the wearer of the shoe 190, he may activate the flashing of the messaging apparatus 100 in athletic situations like shooting a goal or in lifestyle situations like walking on the street.

Moreover, the messaging apparatus may be triggered by using machine learning techniques, such as deep learning algorithms. For example, the triggering may comprise matching with a template of an event, such as shooting a ball, that is defined using known signals of pre-recorded events. The matching may be based on correlation, Matched Filtering, Dynamic Time Warping, or Longest Common Subsequence (LCSS) and its sliding window variant, warping LCSS.

Furthermore, the triggering by may comprise using methods for estimating events based on a Bayesian Classifier such as Naïve Bayes classifier, a maximum margin classifier such as Support Vector Machine, an ensemble learning algorithm such as AdaBoost classifier and a Random Forest classifier, a Nearest Neighbor classifier, a Neural Network classifier, a Rule based classifier, or a Tree based classifier. The triggering may also comprise detecting the event by matching of a template using correlation, Matched Filtering, Dynamic Time Warping, or Longest Common Subsequence (LCSS) and its sliding window variant, warping LCSS.

Alternatively or additionally, triggering may comprise processing features which may be based at least on one of temporal, spatio-temporal, spectral, or ensemble statistics by applying, for example, wavelet analysis, Fast Fourier Transform (FFT), or principal component analysis (PCA). Moreover, the features may be based on one of simple mean, normalized signal energy, movement intensity, signal magnitude area, correlation between axes, maximum value in a window, minimum value in a window, maximum detail coefficient of a wavelet transform, correlation with a template, projection onto a principal component of a template, distance to an eigenspace of a template, spectral centroid, bandwidth, or dominant frequency. These kinds of features have been found to allow for a reliable determination of events associated with human motion.

Figure 2A:
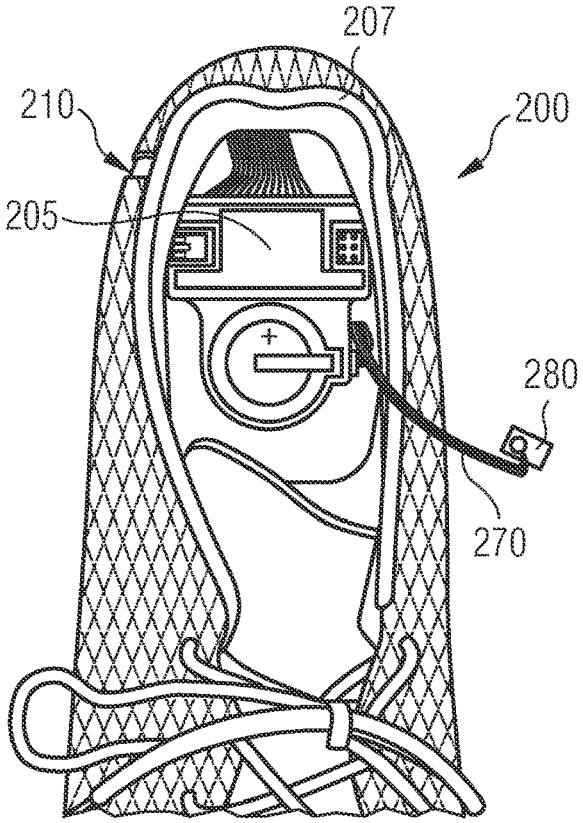
FIGS. 2A-2D illustrate an exemplary shoe comprising a messaging unit according to certain embodiments.
Figure 2B:
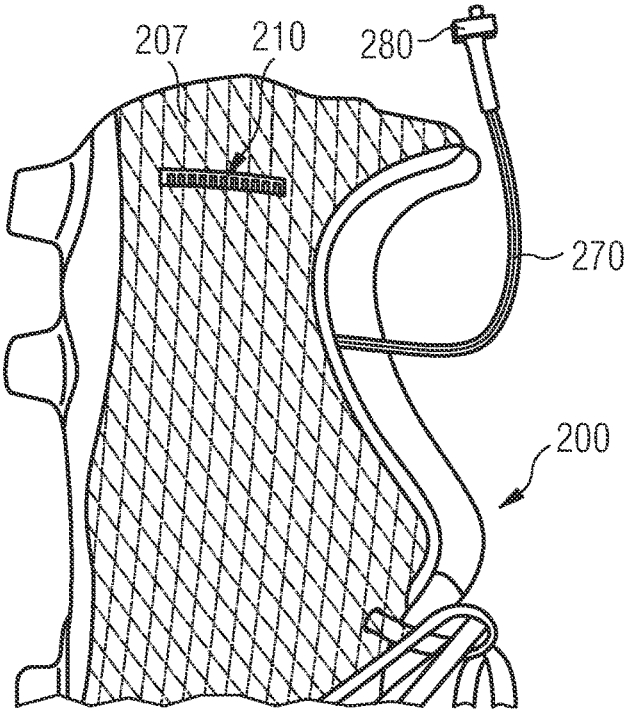
Figure 2C:
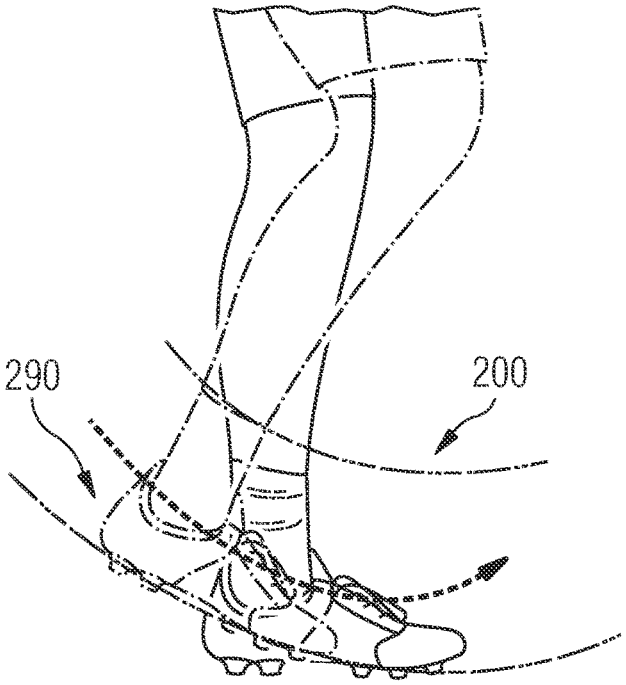
Figure 2D:
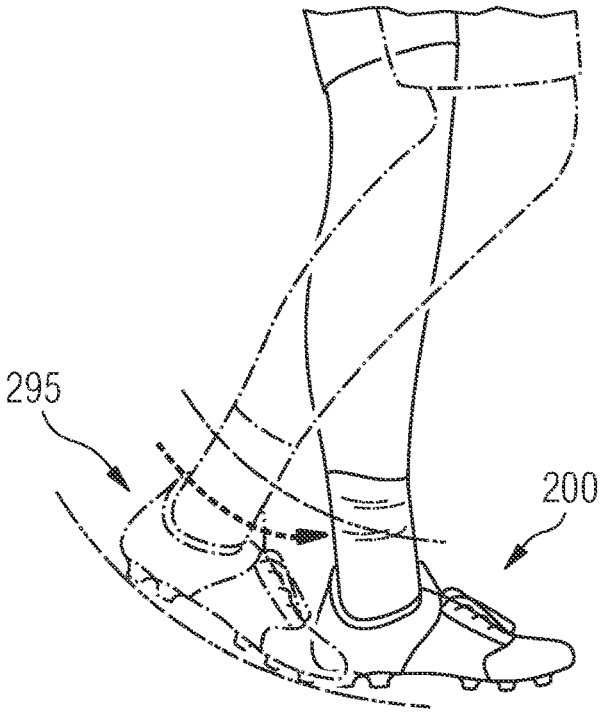

FIGS. 2A-2D illustrate a shoe 200, in particular a soccer shoe, comprising a messaging apparatus 205 according to embodiments of the present invention, and an illustration of the principle for presenting at least one letter, at least one number, graphical elements or design element underlying the present invention. In more detail, FIGS. 2A and 2B present a top view and a side view of the shoe 200, respectively. The messaging apparatus 205 may be the same as messaging apparatus 100. Moreover, FIGS. 2C and 2D present the illustration of the persistence of vision effect for presenting at least one letter, at least one number, graphical elements or design element as explained above.

As can be seen in FIG. 2A, the messaging apparatus 205 may be arranged in a heel part 207 of the shoe 200. In some embodiments, the messaging apparatus 205 may be arranged in another part of the shoe 200, such as in the midfoot part or the forefoot part or that only one messaging apparatus 205 comprises different elements arranged in different locations of the shoe 200. Moreover, the shoe 200 may comprise more than one messaging apparatus 100 or one messaging apparatus comprising more than one light source, for example one for the medial side of the shoe and one for the lateral side. In the embodiment of FIG. 2B there may only be a single arrangement of a plurality of light sources 210, which are arranged on the lateral side of the shoe 200. As described in FIG. 1B, the at least one sensor, the controller and the power source of the messaging apparatus 205 may be arranged under an insole of the shoe 200. Furthermore, the messaging apparatus 205 may comprise an aforementioned switch 280 which may be connected to the messaging apparatus 205 with a flexible wire 270. Advantageously, the switch 280 may be easily taken out of the shoe 200 due to the flexible wire 270.

As can be seen in FIG. 2B, the light source 210 may be surface-mounted LEDs on a circuit board as explained above. The light source 210 may be arranged in a row extending in a direction from the sole to the upper side of the shoe 200. Such an arrangement of the LEDs may allow letters, numbers, graphical symbols or design elements to be presented as will be explained in the following.

FIGS. 2C and 2D present the illustration of the persistence of vision effect for presenting at least one letter, at least one number, graphical elements or design element by using the shoe 200. As can be seen in FIGS. 2C and 2D, a wearer of the shoe 200 performs movements of his leg (indicated with the dashed arrows), wherein the movements may correspond to running or shooting a ball. When the messaging apparatus detects an event, for example, an acceleration above a certain threshold (e.g. 1.5 g) in the horizontal axis, the controller triggers a pre-programmed sequence of light-flashes which generates an image recognizable by the observer using the "persistence of vision" principle which consists of the letters "a", "a", "s" (at thin strip 290 of FIG. 2C) and a thin strip 290 being essentially parallel to the movement of the shoe 200. In FIG. 2D, a triangle 295 may be displayed in the same manner. The letters and the strip 290 may be triggered by a different event than the display of the triangle 295.

In some embodiments, an algorithm as explained above may detect the swing phase of the leg movement. In some embodiments, any other phase (and thus initiating or activation movements) may be detected. Moreover, it is also possible that the messaging apparatus may be tapped several times (e.g., three times) to initiate the flashing during the phase for a certain time period, such as from 10-60 seconds, or such as from 20-50 seconds, or such as 30 seconds. Certain embodiments may use other time periods. Moreover, the messaging apparatus may flash during these time periods in a continuous loop.

In some embodiments, the wearer may choose to display a different message, logo, image or symbol by re-programming the flashing sequence stored in a controller, e.g. controller 130, or by selecting a sequence already stored in the controller 130 using a selection switch which is either actuated directly or remotely. In some embodiments, the flashing sequence may be changed remotely by an observer, for example, a TV producer, or spectator.

Therefore, the shoe 200 provides for the first time the possibility that wearer, such as a professional soccer player or an amateur soccer player wearing such a shoe may present information or design elements, which can be truly recognized by spectators in a stadium or in front of a TV or in leisure time activities by other players or spectators.

In the following, further examples are described to facilitate the understanding of the invention:

1. Messaging unit (100; 205) for a piece of apparel (200), which presents at least one letter, at least one number, a graphical symbol or a design element (290), the unit comprising:
   i. a light source (110; 210), wherein the light source does neither form the at least one letter, nor the at least one number, nor the graphical symbol nor the design element;
   ii. at least one sensor (120) adapted to detect an event; and
   iii. a controller (130) adapted to control a flashing of the light source (110; 210) in response to the detection of the event, so that the at least one letter, at least one number, graphical symbol or design element (290) can be recognized by the viewer.
2. Messaging unit (100; 205) according to the preceding example, wherein the light source (110; 205) comprises light emitting diodes.
3. Messaging unit (100; 205) according to one of examples 1 or 2, wherein the light source (110; 205) has a length in one dimension in the range of 1 cm to 5 cm, preferably 1 cm to 4 cm, more preferably 1 cm to 3 cm and more preferably 1 cm to 2 cm.
4. Messaging unit (100; 205) according to any of the preceding examples, wherein the controller is further adapted to initiate the flashing of the light source (110; 205) when a threshold velocity value is reached.
5. Messaging unit (100; 205) according to any of the preceding examples, wherein the controller is further adapted to initiate the flashing of the light source (110; 205) when a threshold acceleration value is reached.
6. Messaging unit (100; 205) according to the preceding example, wherein the threshold acceleration value is in a range between 1 g to 5 g, preferably between 1 g and 3 g and most preferably between 1.5 g to 2.5 g.
7. Messaging unit (100; 205) according to any of the preceding examples, wherein the at least one sensor (120) is further adapted to determine a direction of a motion.
8. Messaging unit (100; 205) according to the preceding example, wherein the controller (130) is further adapted to initiate the flashing only if the determined direction of the motion is similar to or recognized to be one or more predetermined directions.
9. Messaging unit (100; 205) according to the preceding example, wherein the predetermined direction corresponds to shooting a ball.
10. Messaging unit (100; 205) according to example 8, wherein the predetermined direction corresponds to a jump of a wearer of the piece of apparel (200).
11. Messaging unit (100; 205) according to any of the preceding examples, wherein the controller (130) is further adapted to control the frequency of the flashing depending on the acceleration value of the determined direction of the motion.
12. Messaging unit (100; 205) according to any of the preceding examples, further comprising a means (150) for programming the at least one letter, at least one number, graphical symbol or design element (290).
13. Messaging unit (100; 205) according to any of the preceding examples, further comprising an interface (160) for externally programming the at least one letter, at least one graphical symbol or design element (290).
14. Messaging unit (100; 205) according to any of the preceding examples, wherein the controller (130) is further adapted to initiate the flashing of the plurality of the light sources (110; 205) depending on the reception of an additional external signal.
15. Messaging unit (100; 205) according to any of the preceding examples, wherein the controller (130) is further adapted to track the running distance and/or speed of a wearer of the piece of apparel, preferably by using the at least one sensor (120).
16. Messaging unit (100; 205) according to any of the preceding examples, wherein the at least one sensor (120) comprises at least one of the group of motion-sensing devices, such as accelerometers, gyroscopes, magnetometer, inertial measurement units, proximity sensing devices, such as contact switches or proximity sensor, or orientation sensing devices, such as inclination sensors.
17. Piece of apparel comprising a messaging unit (100; 205) according to any of the preceding examples.
18. Piece of apparel according to the preceding example, wherein the piece of apparel is a shoe, in particular a sports shoe, a garment or a wearable accessory.
19. Shoe (200) according to the preceding example, wherein the light source (110; 210) is arranged on a lateral side of the shoe (200).
20. Shoe (200) according to one of the examples 18 or 19, wherein the light source (110; 210) is arranged in a heel part (207) of the shoe (200).

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A messaging apparatus, comprising:

a light source adapted to perform a flash operation that periodically flashes the light source at a frequency;

a plurality of sensors including a first sensor adapted to detect movement associated with a wearer of a wearable item that includes the messaging apparatus; and a controller adapted to store instructions that cause the controller to:

receive a signal from a second sensor of the plurality of sensors, the signal including trigger data generated in response to a predefined event that occurred external to the messaging apparatus;

detect the trigger data from the signal, wherein detecting the trigger data automatically causes the flash operation to initiate;

evaluate the detected movement of the messaging apparatus; and in response to detecting the trigger data, automatically trigger the light source to perform the flash operation by adjusting the frequency of the flash operation based on the evaluation of the detected movement of the messaging apparatus, wherein the flash operation of the light source forms at least one visible element that is visible to a viewer, and wherein the light source does not form the at least one visible element.

2. The messaging apparatus of claim 1, wherein the second sensor comprises:

an audio capturing device to capture an audio signal generated in response to the predefined event, wherein the audio signal is the signal received at the controller; and wherein the controller is further adapted to:

evaluate the audio signal, wherein evaluating the audio signal includes determining whether the audio signal satisfies an event condition, and wherein satisfying the event condition indicates that the predefined event has occurred;

automatically detect that the predefined event has occurred in response to the controller determining that the audio signal satisfies the event condition; and control the flash operation of the light source in response to the automatic detection of the predefined event.

3. The messaging apparatus of claim 1, wherein the second sensor comprises:

an optical sensor to capture an optical signal representing a lighting condition or illumination surrounding the messaging apparatus, wherein the optical signal is the signal received at the controller and is generated in response to the predefined event; and wherein the controller is further adapted to:

evaluate the optical signal, wherein evaluating the optical signal includes determining whether the optical signal satisfies an event condition, and wherein satisfying the event condition indicates that the predefined event has occurred;

automatically detect that the predefined event has occurred in response to the controller determining that the optical signal satisfies the event condition; and control the flash operation of the light source in response to the automatic detection of the predefined event.

4. The messaging apparatus of claim 1, wherein evaluating the movement of the messaging apparatus further comprises:

accessing a plurality of movement patterns, each movement pattern of the plurality of movement patterns corresponding to a model that represents one or more characteristic movements, and each movement pattern of the plurality of movement patterns being associated with a control sequence that controls the flash operation in a specific manner;

comparing the detected movement of the messaging apparatus with one or more movement patterns of the plurality of movement patterns;

selecting a movement pattern from the plurality of movement patterns, the selection being based on a result of the comparison; and controlling the flash operation using the control sequence associated with the selected movement pattern.

5. The messaging apparatus of claim 4, wherein the control sequence associated with the selected movement pattern is a pre-programmed sequence of light-flashes that, when performed by the light source, generates an image recognizable to the viewer.

6. The messaging apparatus of claim 4, wherein the model that represents the one or more characteristic movements includes a characteristic velocity, a characteristic acceleration, or a characteristic direction associated with an action.

7. The messaging apparatus of claim 1, wherein the controller is further adapted to:

access a plurality of profiles, each profile of the plurality of profiles corresponding to a sport, each profile of the plurality of profiles including code for detecting one or more predefined movements from the movement of the messaging apparatus, and the one or more predefined movements being associated with the sport.

8. The messaging apparatus of claim 1, wherein the signal received at the controller originates from a mobile device executing a native application, wherein the native application executing on the mobile device receives user input that triggers the mobile device to transmit the signal to the controller.

9. The messaging apparatus of claim 1, wherein the messaging apparatus is embedded within a shoe.

10. The messaging apparatus of claim 1, wherein the messaging apparatus is embedded within one or more pieces of sports equipment.

11. The messaging apparatus of claim 1, wherein the controller is further adapted to:

trigger the controlling of the light source using one or more machine-learning techniques.

12. The messaging apparatus of claim 11, wherein the one or more machine-learning techniques are executed to evaluate the detected movement of the messaging apparatus to estimate whether or not the predefined event has occurred, and wherein when the predefined event is estimated to have occurred, the controller triggers the controlling of the light source.

13. The messaging apparatus of claim 1, wherein the movement of the messaging apparatus includes a speed and a direction, and wherein each of the speed and the direction of the movement of the messaging apparatus are non-uniform.

14. The messaging apparatus of claim 1, wherein receiving the signal at the controller causes the messaging apparatus to perform an automatic wake-up from a sleep mode or a low-power mode.

15. The messaging apparatus of claim 1, wherein the plurality of sensors comprises at least one from a group of devices, including: motion sensing devices, accelerometers, gyroscopes, magnetometer, inertial measurement units, proximity sensing devices, contact switches, proximity sensors, orientation sensing devices, and inclination sensors.

16. The messaging apparatus of claim 1, wherein the controller controls the flashing operation based on a known movement pattern associated with a wearer of the messaging apparatus.

17. The messaging apparatus of claim 1, wherein the controller controls the flashing operation based on one or more measurements from a previous operation cycle.

18. The messaging apparatus of claim 1, wherein the controller controls the flashing operation based on one or more measurements of the detected movement of the messaging apparatus.

19. The messaging apparatus of claim 1, wherein the light source includes one or more light emitting diodes (LEDs) embedded within a wearable item.

20. The messaging apparatus of claim 1, wherein the controller is further adapted to:

reduce a power consumption of the messaging apparatus by controlling the light source when the detected movement satisfies a trigger condition, and wherein the trigger condition is associated with a velocity, direction, or acceleration of the messaging apparatus.

* * * * *